US011408155B2

(12) United States Patent
Lu et al.

(10) Patent No.: US 11,408,155 B2
(45) Date of Patent: Aug. 9, 2022

(54) FIXING STRUCTURE FOR WATER PIPE OF SPLIT TYPE FAUCET BODY

(71) Applicant: PPI XIAMEN INDUSTRY CO., LTD., Xiamen (CN)

(72) Inventors: Wenrong Lu, Xiamen (CN); Guangyi Zeng, Xiamen (CN)

(73) Assignee: PPI XIAMEN INDUSTRY CO., LTD., Xiamen (CN)

( * ) Notice: Subject to any disclaimer, the term of this patent is extended or adjusted under 35 U.S.C. 154(b) by 226 days.

(21) Appl. No.: 16/807,175

(22) Filed: Mar. 3, 2020

(65) Prior Publication Data

US 2020/0318326 A1 Oct. 8, 2020

(30) Foreign Application Priority Data

Apr. 3, 2019 (CN) ..... 201920447176.X

(51) Int. Cl.
*E03C 1/04* (2006.01)
*E03C 1/02* (2006.01)

(52) U.S. Cl.
CPC ..... *E03C 1/0403* (2013.01); *E03C 1/025* (2013.01)

(58) Field of Classification Search
CPC ..... E03C 1/0403; E03C 1/025; E03C 1/04
See application file for complete search history.

(56) References Cited

U.S. PATENT DOCUMENTS

| | | | | |
|---|---|---|---|---|
| 4,126,338 | A * | 11/1978 | Coel | F16L 47/04 285/330 |
| 5,826,918 | A * | 10/1998 | Bowles | B60K 15/04 285/24 |
| 8,240,326 | B2 * | 8/2012 | Kacik | F16K 11/0787 137/315.12 |
| 9,109,350 | B2 * | 8/2015 | Zhu | E03C 1/06 |
| 9,939,083 | B2 * | 4/2018 | Kemp | F16K 27/04 |
| 10,281,049 | B2 * | 5/2019 | Ritter | E03C 1/04 |
| 2004/0080160 | A1 * | 4/2004 | Rief | E04H 4/1654 285/276 |
| 2009/0000026 | A1 * | 1/2009 | Hanson | G05D 23/1346 4/695 |
| 2016/0322793 | A1 * | 11/2016 | Cuppen | H02G 3/32 |
| 2020/0102724 | A1 * | 4/2020 | Rosko | E03C 1/0403 |

* cited by examiner

*Primary Examiner* — Patrick C Williams
(74) *Attorney, Agent, or Firm* — W&K IP

(57) ABSTRACT

A fixing structure for a water pipe of a split type faucet body includes: a metal covered plastic water-passing body having a metal outer pipe on the outside, wherein an integrated plastic valve seat is formed in an inner wall of the metal outer pipe, the plastic valve seat is provided with a partition in the middle, and the partition has a first through hole and a second through hole separately, a spool receiving cavity is formed in an inner cavity on one side of the partition, and a first connection passage and a second connection passage are formed in an inner cavity on the other side of the partition; and a water pipe ferrule is provided in its longitudinal direction with two receiving grooves each penetrated up and down, the two receiving grooves are used for placing the first water-passing pipe and the second water-passing pipe respectively.

10 Claims, 9 Drawing Sheets

FIXING STRUCTURE FOR WATER PIPE OF SPLIT TYPE FAUCET BODY

CROSS REFERENCE TO RELATED APPLICATIONS

This application is based upon and claims priority to Chinese Patent Application No. 201920447176.X, filed on Apr. 3, 2019, the entire contents of which are incorporated herein by reference.

FIELD OF THE INVENTION

The present disclosure relates to the field of sanitary ware, and more particularly, to a fixing structure for water pipe of split type faucet body.

BACKGROUND OF THE INVENTION

A traditional faucet body involves a valve body, and a water inlet pipe and a water outlet pipe both connected to the valve body, wherein water flows to the water outlet pipe via a spool in the valve body from the water inlet pipe so that the water flow is controlled. A common faucet valve body is generally formed by integrally casting lead-free copper and then further be welded with red copper pipes (an inlet and an outlet pipes). The process of casting lead-free copper is more complicated, the production cycle is longer, and raw materials of the lead-free copper have a high cost, which ultimately leads to a higher overall production cost. Therefore, some manufactures try to develop a split type faucet body which is formed by assembling a metal shell and a plastic internal valve body structure each formed by molding. This method can avoid the process of casting lead-free copper and cost of raw materials decreases. For example, a fixing structure for a water pipe of a faucet body group in the split type faucet in the Chinese patent No. CN201120082799.5 is assembled through a flange and a plastic valve seat which are used for locking and fixing. However, the flange locking method makes the fixing structure less stable, and prone to loosening in daily use, which affects the service life of the fixing structure. For another example, as described in the fixing structure for a water pipe of the split type faucet body mentioned in the Chinese patent No. CN201620776913.7, "the body seat includes a sleeve and a valve seat disposed in the sleeve, and the valve seat and the sleeve are formed into an integrated structure through two plastic injection moldings; the limiting piece is provided with two notches for fixing the water inlet pipe and the outlet pipe feet respectively. The notches cooperate with a limiting step in the sleeve to form a fixing structure for fixing the faucet body group and the water supply pipe". Although the patent improves the stability between the valve seat and the sleeve, the limiting piece is used for fixing the water inlet pipe feet and the outlet pipe feet, the thin sheet-shaped limiting piece cannot provide a stable support to the water inlet pipe feet and the outlet pipe feet, and it is likely for the water inlet pipe feet and the outlet pipe feet to escape.

SUMMARY OF THE INVENTION

A main object of the present application is to develop a fixing structure for a water pipe of a split type faucet body with low production cost, firm fixing of the water pipes, and easy assembly and disassembly of the water pipes.

In order to achieve the above object, the present application provides a fixing structure for a water pipe of a split type faucet body, which specifically includes:

a metal covered plastic water-passing body, a water pipe ferrule, a first water-passing pipe and a second water-passing pipe, wherein the metal covered plastic water-passing body has a metal outer pipe on the outside, and an integrated plastic valve seat is formed by two-shot plastic injection molding on an inner wall of the metal outer pipe; the plastic valve seat is provided with a partition in the middle, and the partition has two through holes spaced apart from each other, i.e., a first through hole and a second through hole; a spool receiving cavity is formed in an inner cavity on one side of the partition, and a first connection passage and a second connection passage for positioning and connecting with the first water-passing pipe and the second water-passing pipe respectively are formed in an inner cavity on the other side of the partition, the first connection passage being in communication with the first through-hole, and the second connection passage being in communication with the second through-hole; at the same time, a plurality of limiting holes are provided in an inner wall of an outlet end of the metal covered plastic water-passing body that faces the side of the first connection passage and the second connection passage; the water pipe ferrule is a cylinder having an outer diameter less than or equal to an inner diameter of the metal covered plastic water-passing body, and the water pipe ferrule is provided in its longitudinal direction with two receiving grooves each penetrated up and down; the two receiving grooves are used for placing the first water-passing pipe and the second water-passing pipe respectively, and the water pipe ferrule is provided on an outer wall thereof with a plurality of elastic snap-fit points; when the water pipe ferrule is sleeved over an inner end of the metal covered plastic water-passing body on the side of the first connection passage and the second connection passage, a joint of the first water-passing pipe and a joint of the second water-passing pipe are respectively inserted into the first connection passage and the second connection passage to realize fixed installation and ensure the communication of the water pipes; at the same time, the elastic snap-fit points and the limiting holes on the inner wall of the metal covered plastic water-passing body are snap-fitted to ensure that the water pipe ferrule is stably placed inside the metal covered plastic water-passing body.

After the above structure is adopted, the metal covered plastic water-passing body is used in the fixing structure for the water pipe of the split type faucet body, and the valve seat is formed by performing a two-shot plastic injection molding process in the inner cavity of the water-passing body. The water pipe ferrule is additionally provided, which is detachably disposed in the inner cavity of the water-passing body. Since the water pipe ferrule is a cylinder having a receiving groove at a certain depth on both sides along its axial position, when the first water-passing pipe and the second water-passing pipe are disposed in the receiving grooves, it can be ensured that the first water-passing pipe and the second water-passing pipe are stably fixed between the water pipe ferrule and the inner wall of the water-passing body. And at the same time, since an end of the water pipe ferrule has elastic snap-fit points, which makes it easy to be installed and detached, the use of this technical solution reduces the manufacturing cost. And at the same time, the technical solution enhances the stable connection between the first water-passing pipe and the second water-passing pipe with the water-passing body, and also promotes the convenience of water pipe assembly and disassembly.

DETAILED DESCRIPTION OF THE EMBODIMENT(S) OF THE INVENTION

Figure 1:
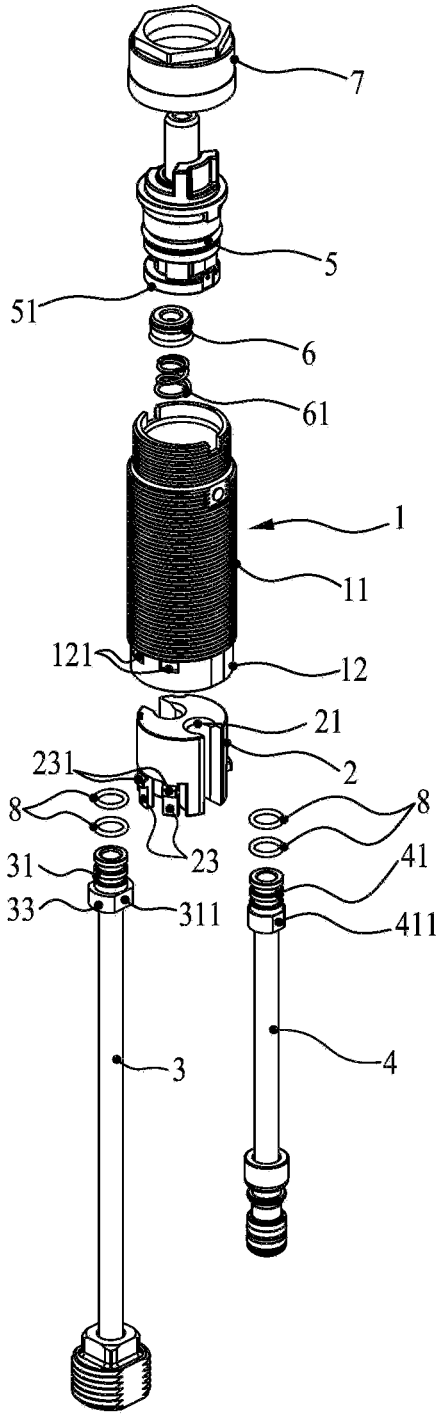
FIG. 1 is an exploded view of an embodiment.
Figure 2:
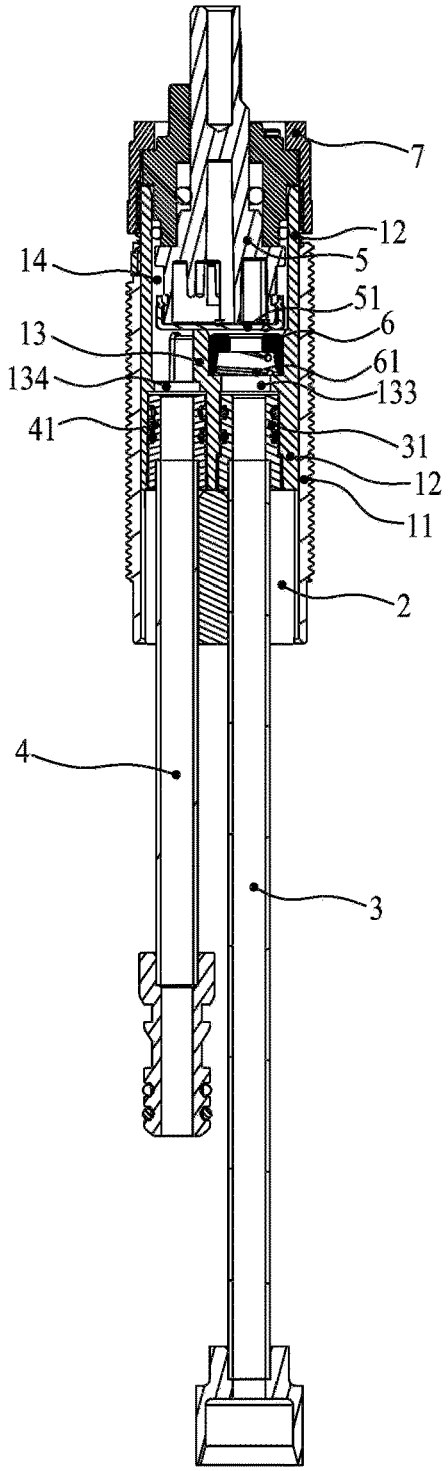
FIG. 2 is a sectional view of the embodiment.
Figure 3:
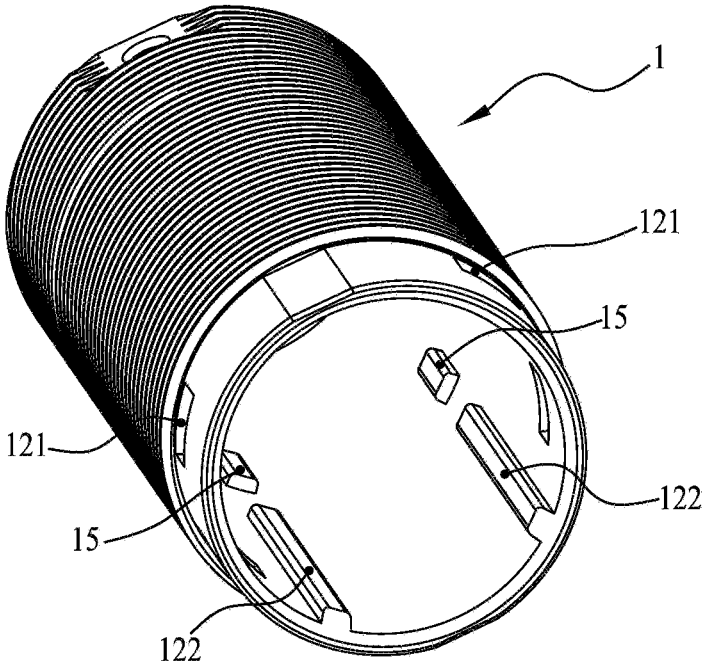
FIG. 3 is a perspective view of a metal outer pipe of a metal covered plastic water-passing body according to the embodiment.
Figure 4:
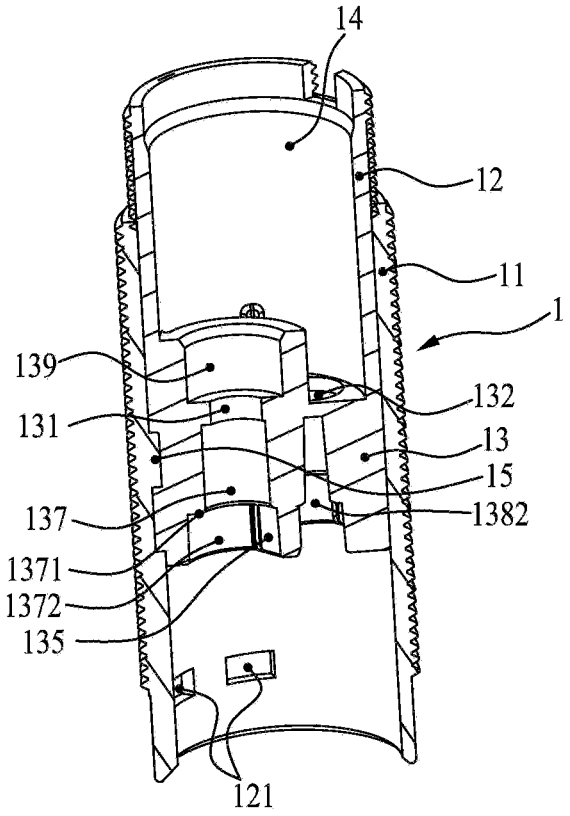
FIG. 4 is a perspective cross-sectional view of the metal covered plastic water-passing body according to the embodiment.
Figure 5:
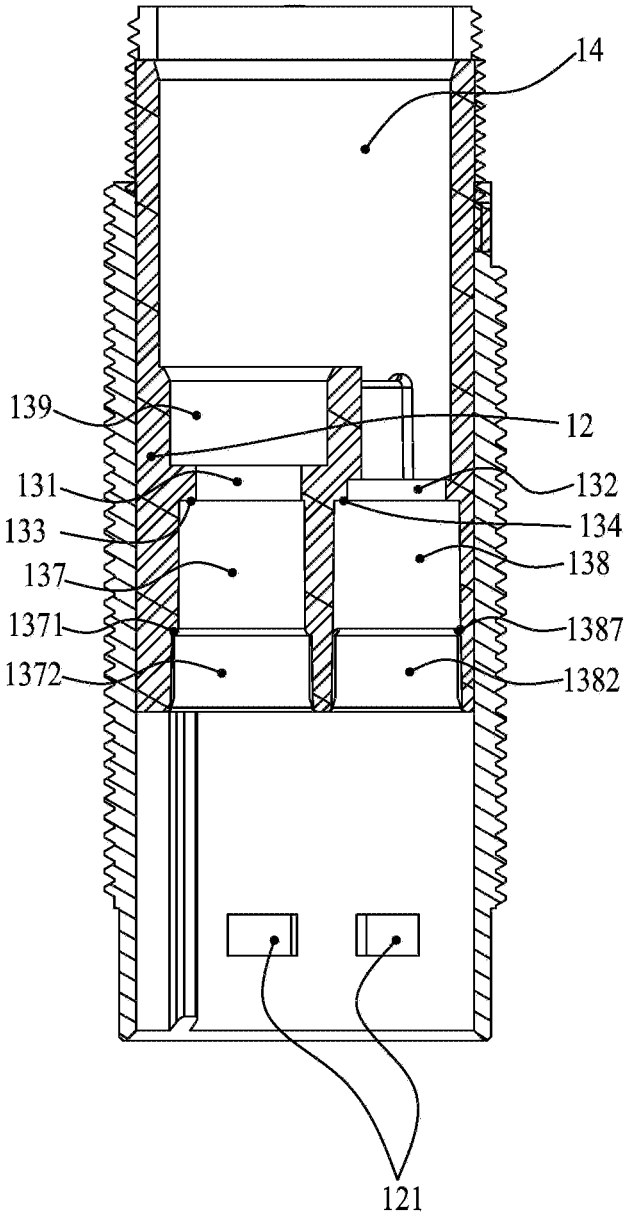
FIG. 5 is a cross-sectional view of the metal covered plastic water-passing body according to the embodiment.
Figure 6:
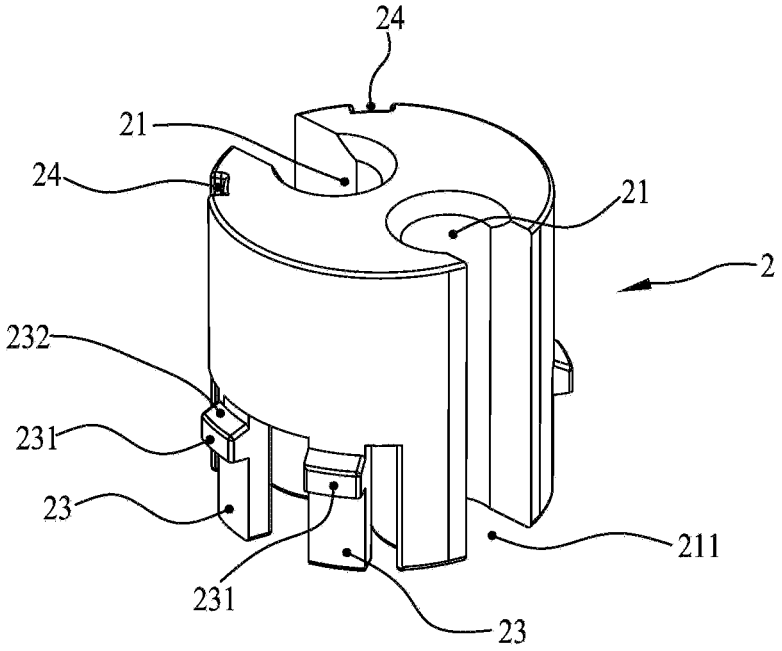
FIG. 6 is a first perspective view of a water pipe ferrule of the embodiment.
Figure 7:
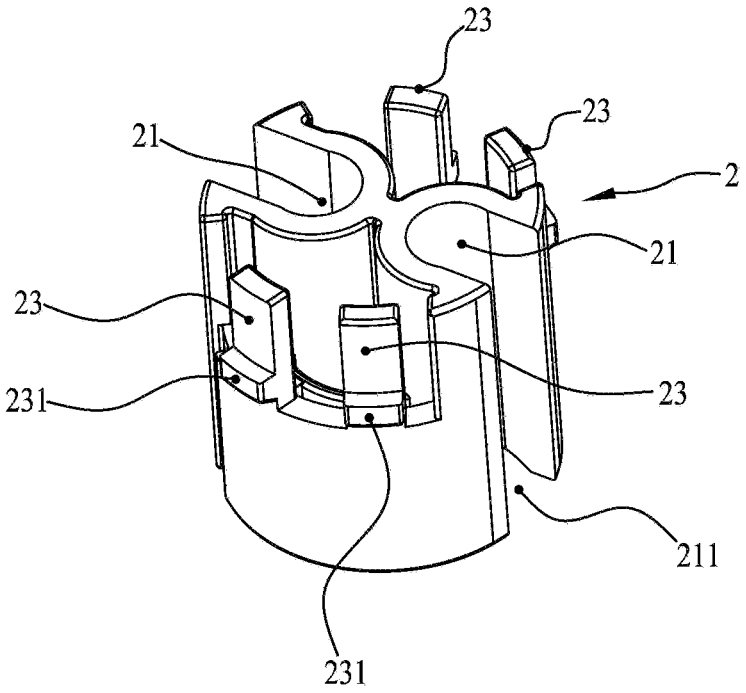
FIG. 7 is a second perspective view of the water pipe ferrule of the embodiment.
Figure 8:
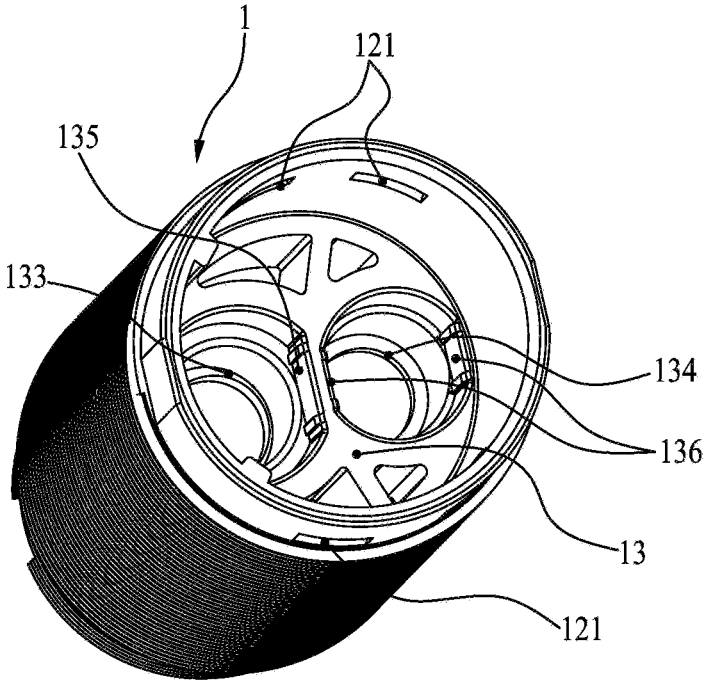
FIG. 8 is a perspective view of the metal covered plastic water-passing body according to the embodiment.
Figure 9:
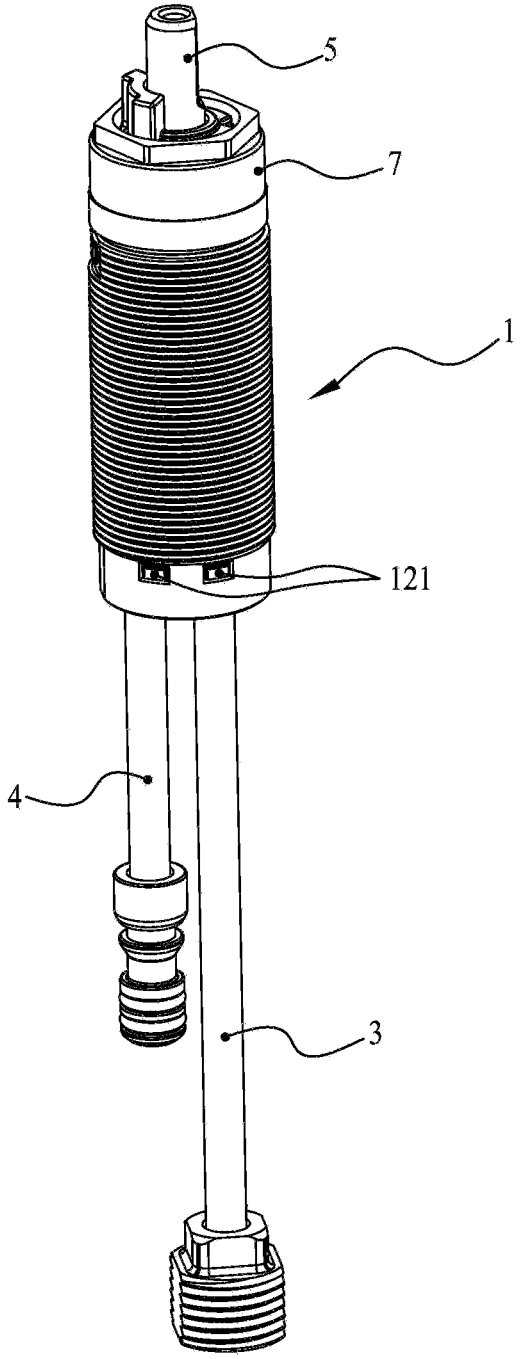
FIG. 9 is a schematic assembly view of the embodiment.

As shown in FIG. 1 to FIG. 9, a fixing structure for a water pipe of a split type faucet body includes: a metal covered plastic water-passing body 1, a water pipe ferrule 2, a first water-passing pipe 3 and a second water-passing pipe 4; wherein the metal covered plastic water-passing body 1 has a metal outer pipe 11 on the outside. As shown in FIG. 3, an inner wall of the metal outer pipe 11 is provided with at least one fixed boss 15. An integrated plastic valve seat 12 is formed by two-shot plastic injection molding on an inner wall of the metal outer pipe 11, and covers the fixed boss 15, so that the plastic valve seat 12 formed by two-shot plastic injection molding is not easy to fall off. The plastic valve seat 12 is provided with a partition 13 in a middle portion, and the partition 13 has two through holes spaced apart from each other, i.e., a first through hole 131 and a second through hole 132. A spool receiving cavity 14 is formed in an inner cavity on one side of the partition 13. An installation cavity 139 is formed above the first through hole 131 in the partition 13, and a first connection passage 137 is formed below the first through hole 131. A necked portion 133 is formed between the first through hole 131 and the first connection passage 137. A stepped surface 1371 is formed below the first connection passage 137 so that a counterbore 1372 is formed. A side wall of the counterbore 1372 has a raised limiting guide surface 135. The installation cavity 139, the first through hole 131, the first connection passage 137, and the counterbore 1372 are in communication with each other from top to bottom. A second connection passage 138 is formed below the second through hole 132. A second necked portion 134 is formed between the second through hole 132 and the second connection passage 138. A stepped surface 1381 is formed below the second connection passage 138 so that a counterbore 1382 is formed, and a side wall of the counterbore 1382 has a raised limiting guide surface 1361. The second through hole 132, the second connection passage 138, and the counterbore 1382 are in communication with each other from top to bottom; a connection block 33 is disposed below a joint 31 of the first water-passing pipe 3. And a snap-fit surface 311 is disposed on a side wall of the connection block 33. A connection block 43 is disposed below a joint 41 of the second water-passing pipe 4, and a snap-fit surface 411 is disposed on a side wall of the connection block 43. When the water pipe ferrule 2 is sleeved over an inner end of the metal covered plastic water-passing body 1 on the side of the first connection passage 137 and the second connection passage 138, the joint 31 of the first water-passing pipe 3 is inserted into the first connection passage 137, a top end of the joint 31 is abutted against the first necked portion 133, the joint 41 of the second water-passing pipe 4 is inserted into the second connection passage 138, and a top end of the joint 41 is abutted against the second necked portion 134; the snap-fit surface 311 and the limiting guide surface 135 are snap-fitted, and the snap-fit surface 411 and the limiting guide surface 136 are snap-fitted, thus effectively realizing that the first water-passing pipe 3 and the second water-passing pipe 4 are fixedly installed in the first connection passage 137 and the second connection passage 138, and preventing the first water-passing pipe 3 and the second water-passing pipe 4 from rotating in the first connection passage 137 and the second connection passage 138. The first connection passage 137 and the second connection passage 138 each have a certain depth to ensure a clamping effect on the first water-passing pipe 3 and the second water-passing pipe 4 installed therein.

At the same time, a plurality of limiting holes 121 are disposed on an inner wall of an outlet end of the metal covered plastic water-passing body 1 that faces the side of the first connection passage 137 and the second connection passage 138.

The water pipe ferrule 2 is a cylinder having an outer diameter less than or equal to an inner diameter of the metal covered plastic water-passing body 1, and the water pipe ferrule 2 is provided in its longitudinal direction with two receiving grooves 21 each penetrated up and down. The two receiving grooves 21 are used for placing the first water-passing pipe 3 and the second water-passing pipe 4 respectively, and the two receiving grooves 21 are provided with side wall notches 211 in a direction toward the outer wall. The first water-passing pipe 3 and the second water-passing pipe 4 that need to be installed may be placed into the receiving grooves 21 from the side wall notches 211. In this embodiment, the first water-passing pipe 3 is a water inlet pipe, the second water-passing pipe 4 is a water outlet pipe, and the receiving grooves 21 of the water pipe ferrule 2 each have a certain depth which is sufficient to ensure a limiting effect on the internal first and the second water-passing pipes.

As shown in FIG. 5 to FIG. 8, an outer wall of the water pipe ferrule 2 is provided with four elastic cantilevers 23. The elastic cantilevers 23 are disposed on the outer wall of the water pipe ferrule 2 and parallel to the longitudinal axis of the water pipe ferrule. Each elastic cantilever 23 is provided with an outwardly protruding snap-fit point 231 respectively, and the snap-fit points 231 correspond to the four limiting holes 121 in the inner wall of the metal covered plastic water-passing body 1 one on one. When the water pipe ferrule 2 is sleeved over the inner end of the metal covered plastic water-passing body 1 on the side of the first connection passage 137 and the second connection passage 138, the joint 31 of the first water-passing pipe 3 and the joint 41 of the second water-passing pipe 4 are inserted into the first connection passage 137 and the second connection passage 138 respectively to realize communication of the water pipes. At the same time, the snap-fit point 231 on each elastic cantilever 23 is just snap-fitted into each of the limiting holes 121. By snap fitting the snap-fit points 231 with the limiting holes 121 in the inner wall of the metal covered plastic water-passing body 1, it is ensured that the water pipe ferrule 2 is stably disposed in the metal covered plastic water-passing body 1. A plurality of sealing rings are sleeved over the joint 31 of the first water-passing pipe 3 and the joint 41 of the second water-passing pipe 4 respectively, so that when the joint 31 and the joint 41 are inserted into the first connection passage 137 and the second connection passage 138, a sealed connection is realized.

As shown in FIG. 3, the outer wall of the water pipe ferrule 2 is further provided with a second limiting structure. The second limiting structure is two longitudinal grooves 24 disposed in the outer wall, and the metal covered plastic water-passing body 1 is provided with a second snap-fit structure in an inner wall of the outlet end facing the side of the first connection passage 137 and the second connection passage 138 for snap fitting with the second limiting structure. The second snap-fit structure is two ribs 122 disposed longitudinally on the inner wall, as shown in FIG. 3. The two longitudinal grooves 24 correspond to the two ribs 122 one on one. When the water pipe ferrule 2 is sleeved over the inner end of the metal covered plastic water-passing body 1 on the side of the first connection passage 137 and the second connection passage 138, the two ribs 122 disposed in the longitudinal direction are just snap-fitted into the two longitudinal grooves 24 respectively to prevent the water pipe ferrule 2 from rotating in the metal covered plastic water-passing body 1.

As shown in FIG. 1 to FIG. 2, a split type faucet body includes the above described fixing structure for the water pipe of the split type faucet body, and further includes a spool 5 which is rotatably assembled into the spool receiving cavity 14 of the metal covered plastic water-passing body 1. The spool 5 is provided on an end surface facing the partition 13 with at least one third through hole(the drawing is not shown) that may communicate with the first through hole 131 or the second through hole 132, and a water-blocking sealing surface(the drawing is not shown). A water passage is formed in an inner cavity of the spool 5, which is in communication with the third through hole. By adjusting a size of the water passing area between the third through hole of the spool 5 and the first or second through hole(131, 132), an adjustment of the flow of the faucet body is realized. A spool presser 7 is connected above the spool receiving cavity 14 to fix the spool 5 in the spool receiving cavity 14. The installation cavity 139 has a built-in water blocking pad 6 having an inverted bowl shape. A bottom surface of the inverted bowl shape of the water blocking pad 6 faces an end surface 51 of the spool 5. A cone spring 61 is compressed downward inside the water blocking pad 6. A restored elasticity generated by the compressed cone spring 61 enables the bottom surface of the inverted bowl shape of the water blocking pad 6 to be abutted upwardly against the end surface 51 of the spool 5 closely under force, thereby realizing a sealing effect effectively.

The water flow enters the water inlet pipe (the first water-passing pipe 3), then enters the spool from a water inlet of the spool 5, and is controlled by the spool 5 to flow out of the spool 5 and into the water outlet pipe (the second water-passing pipe 4), thereby achieving the control and circulation of the entire water flow.

The scope of protection of the present disclosure is not limited to the embodiment in which two water-passing pipes are provided, and may be further applied to a situation of three or more water-passing pipes if necessary.

The above description merely relates to embodiments of the present disclosure, and is not intended to limit the design of the present disclosure. Any equivalent changes made according to key points of the design of the present disclosure will fall within the scope of protection of the present disclosure.

We claim:

1. A fixing structure for a water pipe of a split type faucet body, comprising a metal covered plastic water-passing body, a water pipe ferrule, a first water-passing pipe and a second water-passing pipe, wherein the metal covered plastic water-passing body has a metal outer pipe on the outside, and an integrated plastic valve seat formed by two-shot plastic injection molding on an inner wall of the metal outer pipe; the integrated plastic valve seat is provided with a partition in the middle, and the partition has a first through hole and a second through hole spaced apart from each other; a spool receiving cavity is formed in an inner cavity on one side of the partition, and a first connection passage for positioning and connecting with the first water-passing pipe and a second connection passage for positioning and connecting with the second water-passing pipe are formed in an inner cavity on the other side of the partition, the first connection passage being in communication with the first through hole, and the second connection passage being in communication with the second through hole; a plurality of limiting holes are provided in an inner wall of an outlet end of the metal covered plastic water-passing body that faces the side of the first connection passage and the second connection passage; the water pipe ferrule is a cylinder having an outer diameter less than or equal to an inner diameter of the metal covered plastic water-passing body, and the water pipe ferrule is provided in its longitudinal direction with two receiving grooves each penetrated up and down; the two receiving grooves are used for placing the first water-passing pipe and the second water-passing pipe respectively, and the water pipe ferrule is provided on an outer wall thereof with a plurality of elastic snap-fit points; when the water pipe ferrule is sleeved over an inner end of the metal covered plastic water-passing body on the side of the first connection passage and the second connection passage, a joint of the first water-passing pipe and a joint of the second water-passing pipe are inserted into the first connection passage and the second connection passage respectively to realize a fixed installation and ensure the communication of the water pipes; the elastic snap-fit points and the limiting holes on the inner wall of the metal covered plastic water-passing body are snap-fitted to ensure that the water pipe ferrule is stably placed inside the metal covered plastic water-passing body;

the outer wall of the water pipe ferrule is further provided with a second limiting structure, the metal covered plastic water-passing body is provided with a second snap-fit structure in an inner wall of the outlet end thereof facing the side of the first connection passage and the second connection passage, and the second limiting structure correspond to the second snap-fit structure one on one; and when the water pipe ferrule is sleeved over the inner end of the metal covered plastic water-passing body on the side of the first connection passage and the second connection passage, the second limiting structure is snap-fitted with the second snap-fit structure one on one so that the water pipe ferrule is not rotatable in the metal covered plastic water-passing body.

2. The fixing structure for a water pipe of a faucet body according to claim 1, wherein a first necked portion is formed between the first through hole in the partition and the first connection passage; a second necked portion is formed between the second through hole and the second connection passage; and when the water pipe ferrule is sleeved over the inner end of the metal covered plastic water-passing body on the side of the first connection passage and the second connection passage, the joint of the first water-passing pipe is inserted into the first connection passage and abutted against the first necked portion, and the joint of the second water-passing pipe is inserted into the second connection passage and abutted against the second necked portion so that a communication of the water pipes is realized.

3. The fixing structure for a water pipe of a faucet body according to claim 2, wherein an installation cavity is formed above the first through hole.

4. The fixing structure for a water pipe of a faucet body according to claim 1, wherein side walls of the first connection passage and the second connection passage are each provided with a limiting structure, side walls of the joint of the first water-passing pipe and the joint of the second water-passing pipe are each provided with a snap-fit structure, and the number of the snap-fit structures is the same as that of the limiting structures; and when the joint of the first water-passing pipe and the joint of the second water-passing pipe are installed into the first connection passage and the second connection passage, the snap-fit structures and the limiting structures are snap-fitted respectively so that the first water-passing pipe and the second water-passing pipe are prevented from rotating in the first connection passage and the second connection passage.

5. The fixing structure for a water pipe of a faucet body according to claim 4, wherein the limiting structures are raised limiting guide surfaces extending outwardly from the sides walls of the first connection passage and the second connection passage, and the snap-fit structures are horizontal snap-fit surfaces disposed on the side walls of the joint of the first water-passing pipe and the joint of the second water-passing pipe; and when the joint of the first water-passing pipe and the joint of the second water-passing pipe are installed into the first connection passage and the second connection passage, the snap-fit surfaces and the limiting guide surfaces are snap-fitted respectively.

6. The fixing structure for a water pipe of a faucet body according to claim 1, wherein the two receiving grooves in the water pipe ferrule are provided with side wall notches in a direction toward the outer wall, and the first water-passing pipe and the second water-passing pipe that need to be installed can be placed into the receiving grooves through the side wall notches.

7. The fixing structure for a water pipe of a faucet body according to claim 6, wherein a width of each side wall notch is smaller than a diameter of the first water-passing pipe or the second water-passing pipe that needs to be installed.

8. The fixing structure for a water pipe of a faucet body according to claim 1, wherein the second limiting structure on the water pipe ferrule is a plurality of longitudinal grooves disposed in the outer wall, and the second snap-fit structure on the inner wall of the metal covered plastic water-passing body is a plurality of ribs disposed longitudinally on the inner wall; and when the water pipe ferrule is sleeved over the inner end of the metal covered plastic water-passing body on the side of the first connection passage and the second connection passage, the plurality of longitudinal ribs are snap-fitted into the plurality of longitudinal grooves one on one to prevent the water pipe ferrule from rotating in the metal covered plastic water-passing body.

9. The fixing structure for a water pipe of a faucet body according to claim 1, wherein the outer wall of the water pipe ferrule is provided with a plurality of elastic cantilevers, the elastic cantilevers are disposed on the outer wall of the water pipe ferrule and parallel to the longitudinal axis of the water pipe ferrule, and each elastic cantilever is provided with an outwardly protruding snap-fit point; and when the water pipe ferrule is sleeved over the inner end of the metal covered plastic water-passing body on the side of the first connection passage and the second connection passage, the snap-fit point on each elastic cantilever is snap-fitted into each limiting hole.

10. The fixing structure for a water pipe of a faucet body according to claim 9, wherein the snap-fit point has a guide surface for facilitating insertion of the water pipe ferrule into an inner cavity of the metal covered plastic water-passing body.

* * * * *